US007975831B2

(12) United States Patent
Ponti

(10) Patent No.: US 7,975,831 B2
(45) Date of Patent: Jul. 12, 2011

(54) CONVEYING APPARATUS FOR CHANGING THE FORWARD MOTION DIRECTION OF SHEET ARTICLES

(75) Inventor: Francesco Ponti, Cerbara-Citta'di Castello (Perugia) (IT)

(73) Assignee: C.M.C. S.r.l., Cerbara-Citta' di Castello (Perugia) (IT)

( * ) Notice: Subject to any disclaimer, the term of this patent is extended or adjusted under 35 U.S.C. 154(b) by 372 days.

(21) Appl. No.: 12/160,928

(22) PCT Filed: Jan. 12, 2007

(86) PCT No.: PCT/EP2007/050304

§ 371 (c)(1),
(2), (4) Date: Jul. 15, 2008

(87) PCT Pub. No.: WO2007/082849

PCT Pub. Date: Jul. 26, 2007

(65) Prior Publication Data

US 2010/0193328 A1 Aug. 5, 2010

(30) Foreign Application Priority Data

Jan. 17, 2006 (IT) ..... BO2006A0025

(51) Int. Cl.
*B65G 47/82* (2006.01)

(52) U.S. Cl. ..... 198/597; 198/457.03; 198/457.07; 271/225; 271/184

(58) Field of Classification Search ..... 198/597, 198/456, 457.01, 457.02, 457.03, 457.06, 198/457.07; 271/225, 184
See application file for complete search history.

(56) References Cited

U.S. PATENT DOCUMENTS

| | | | | | |
|---|---|---|---|---|---|
| 4,527,792 | A * | 7/1985 | Burkhardt | 271/225 |
| 4,572,350 | A * | 2/1986 | Besemann | 198/370.07 |
| 4,986,730 | A * | 1/1991 | Wetter | 414/792.7 |
| 5,112,041 | A * | 5/1992 | Honegger | 271/286 |
| 5,188,355 | A * | 2/1993 | Lowell et al. | 271/225 |
| 5,282,528 | A * | 2/1994 | Hudson | 198/451 |
| 5,413,326 | A * | 5/1995 | Wright | 271/225 |
| 5,433,430 | A * | 7/1995 | Straessler et al. | 271/225 |
| 5,503,386 | A * | 4/1996 | Straessler et al. | 271/225 |
| 5,538,239 | A * | 7/1996 | Auerbach et al. | 271/225 |
| 5,597,156 | A * | 1/1997 | Claassen | 271/225 |
| 6,041,910 | A * | 3/2000 | Avery et al. | 198/370.07 |
| 6,105,955 | A * | 8/2000 | Rawlings et al. | 271/11 |
| 6,155,560 | A * | 12/2000 | Cote et al. | 271/225 |
| 6,158,735 | A * | 12/2000 | Cote et al. | 271/302 |
| 6,406,014 | B1 * | 6/2002 | Reist | 271/3.24 |
| 6,581,929 | B2 * | 6/2003 | Hiramitsu | 271/228 |
| 6,817,608 | B2 * | 11/2004 | Sloan et al. | 271/216 |
| 6,843,359 | B2 * | 1/2005 | Ballestrazzi et al. | 198/418.6 |

(Continued)

*Primary Examiner* — Joe Dillon, Jr.
(74) *Attorney, Agent, or Firm* — William J. Sapone; Coleman Sudol Sapone P.C.

(57) ABSTRACT

A conveying apparatus is capable of changing the forward motion direction (V1) of sheet articles (10) by means of a first rotating diverting member (4) situated above a lower active run (2*h*) of a second conveyor (2). The second conveyor is disposed at an angle (H1) with respect to the first conveyor (1) and the first rotating diverting member (4) is shaped like a cam with an active portion (4*h*) for moving the sheet article to the second conveyor without changing orientation of the sheet article. A third conveyor (3) can be added, at an angle (H2) with respect to the second conveyor, with a second rotating diverting member (5) for moving the sheet articles from the second conveyor to the third conveyor (3) without changing orientation of the sheet articles.

15 Claims, 4 Drawing Sheets

U.S. PATENT DOCUMENTS 6,868,957 B2 * 3/2005 Cassoli et al. ..... 198/370.08
7,124,877 B2 * 10/2006 Honegger ..... 198/608
7,377,375 B2 * 5/2008 Feigel et al. ..... 198/377.06
7,416,072 B2 * 8/2008 Gosset ..... 198/429
7,510,182 B2 * 3/2009 Bobrow ..... 271/185
7,690,497 B2 * 4/2010 Radwallner et al. ..... 198/457.03
7,706,737 B2 * 4/2010 Lang ..... 399/397
7,758,043 B2 * 7/2010 Keller ..... 271/225

* cited by examiner

CONVEYING APPARATUS FOR CHANGING THE FORWARD MOTION DIRECTION OF SHEET ARTICLES

BACKGROUND OF THE INVENTION

The present invention relates to conveying apparatuses, which forward sheets at high operation speed, and which are adapted particularly for changing the forward motion direction of the sheets, and are designed for special industrial applications.

DESCRIPTION OF THE PRIOR ART

The main object of the present invention is to propose a conveying apparatus aimed at changing the sheet forward motion direction by an angle of 90 degrees, keeping unchanged the sheet orientation, between an inlet section and an outlet section.

The above object is obtained by devising an apparatus, which is capable of working at high operation speeds, typical for the applications, in which it is to be incorporated.

Another object of the present invention is to propose a conveying apparatus for changing the sheet forward motion direction, with a simple concept, an essential structure, and which is efficient, reliable and whose costs are relatively low with respect to the results to be obtained.

The above mentioned objects are obtained, in accordance with the contents of the claims, by a conveying apparatus for changing the forward motion direction of sheet articles, characterized in that it includes:

at least a first conveyor with at least a first conveyor lower active run extending between a first conveyor inlet section and a first conveyor outlet section, the first conveyor being operated along a first longitudinal direction line and in a first forward direction for moving forward said sheet articles;

at least a second conveyor disposed functionally in cascade after the first conveyor, and having at least a second conveyor lower active run extending between a second conveyor inlet section and a second conveyor outlet section the second conveyor being operated in a second forward direction, substantially concordant with the first forward direction and along a second longitudinal direction line inclined by a first angle with respect to said first longitudinal direction line;

a first rotating diverting member, situated above said second conveyor lower active run of said second conveyor and near said second conveyor inlet section, the first diverting member having rotation axis substantially perpendicular to said second longitudinal direction line, and operated in time relation with passage of a sheet article on said first conveyor, said first rotating diverting member having an active portion designed to contact corresponding portions of each sheet article arriving at said first conveyor outlet section and to push the sheet article onto said second conveyor, without changing orientation of said sheet article.

BRIEF DESCRIPTION OF THE DRAWINGS

The characteristic features of the invention, which do not appear from what has been just said, will be pointed out in the following, in accordance with the claims and with reference to the enclosed figures, in which:

MODES OF CARRYING OUT THE INVENTION

Figure 1:
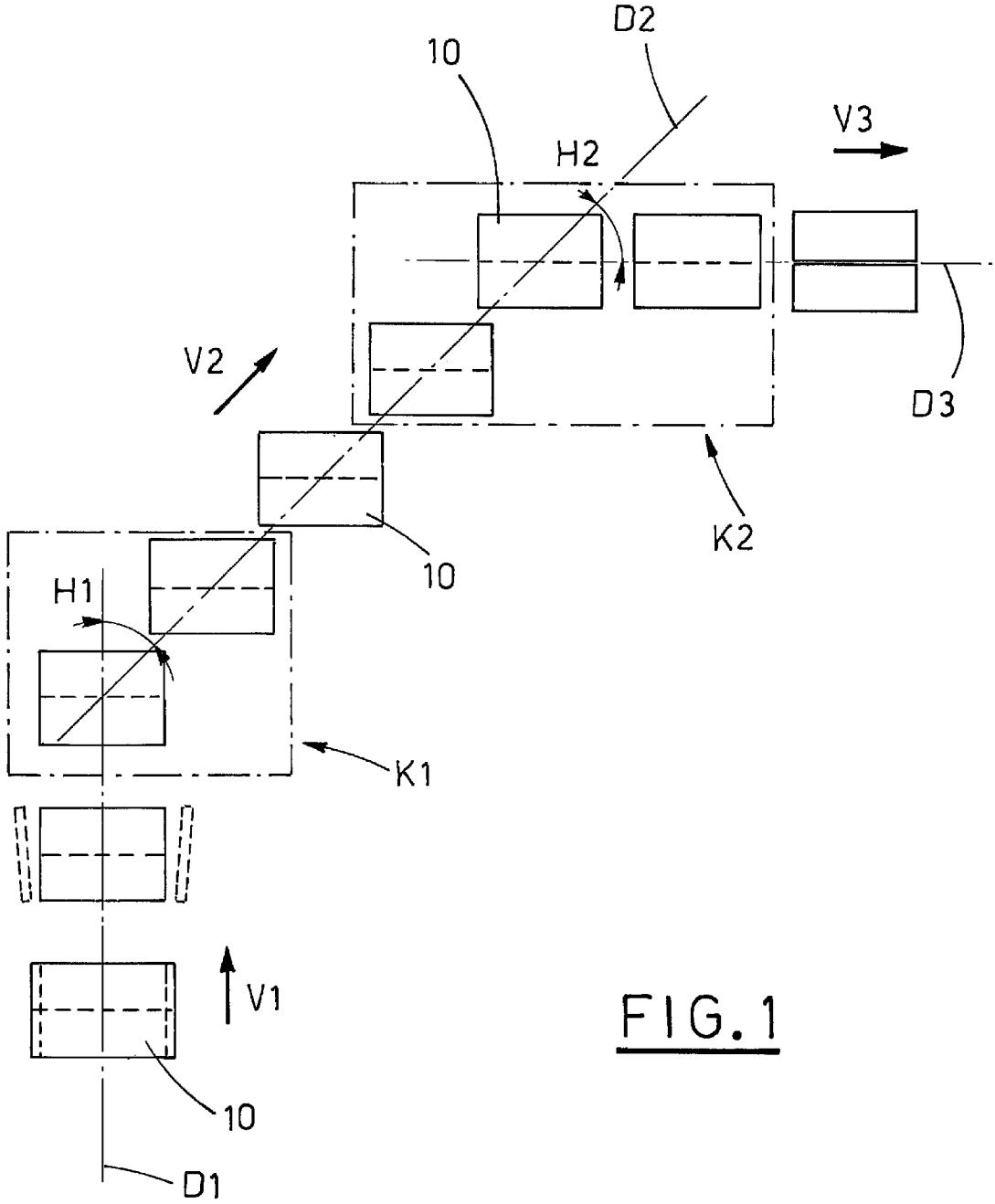
FIG. 1 is a qualitative and schematic, top view, of the path followed by the sheets inside the proposed apparatus.

Having regard to the enclosed Figures, the reference numeral 1 indicates a first pair of conveyor belts 1A, 1B (later called first upper conveyor belt 1A and first lower conveyor belt 1B, arranged with respect to each other in such a way as to define two active runs, lower 1*h* and upper 1*j*, facing each other along a given section, and operated at the same speed in a first longitudinal direction line D1 and in a forward direction V1.

The two active runs 1*h*, 1*j* are aimed at receiving the sheets 10 at an inlet section and at conveying them, one by one, toward an outlet section 1U.

Figure 2:
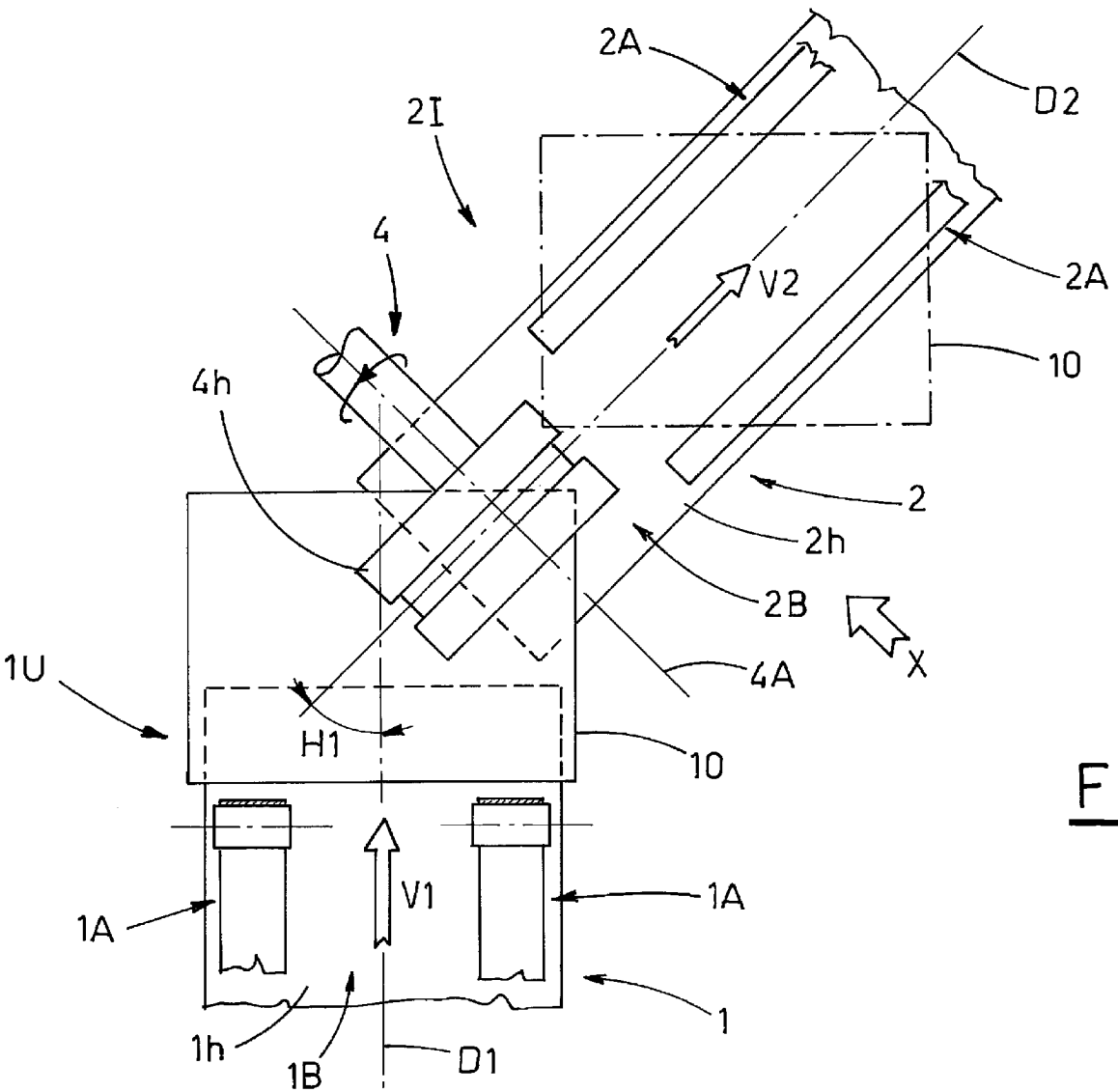
FIG. 2 is an enlarged view of the particular K1 indicated in FIG. 1.

In particular, the lower active run 1*h* extends further beyond the upper active run 1*j* at its outlet section 1U, by a given quantity W1 (see FIG. 2, 4A, 4B).

The reference numeral 2 indicates a second pair of conveyor belts 2A, 2B (later called second conveyor belt 2A and second lower conveyor belt 2B), functionally disposed in cascade after the first pair of conveyors 1.

The conveyor belts 2A, 2B are arranged with respect to each other in such a way as to define two active runs, a lower run 2*h* and an upper run 2*j*, facing each other along a given section, and operated at the same speed in a second longitudinal direction line D2 and in a forward direction V2.

The two active runs 2*h*, 2*j* are aimed at receiving the sheets 10 at their inlet section 2I and at conveying them, one by one, toward the outlet section 2U.

Figure 3:
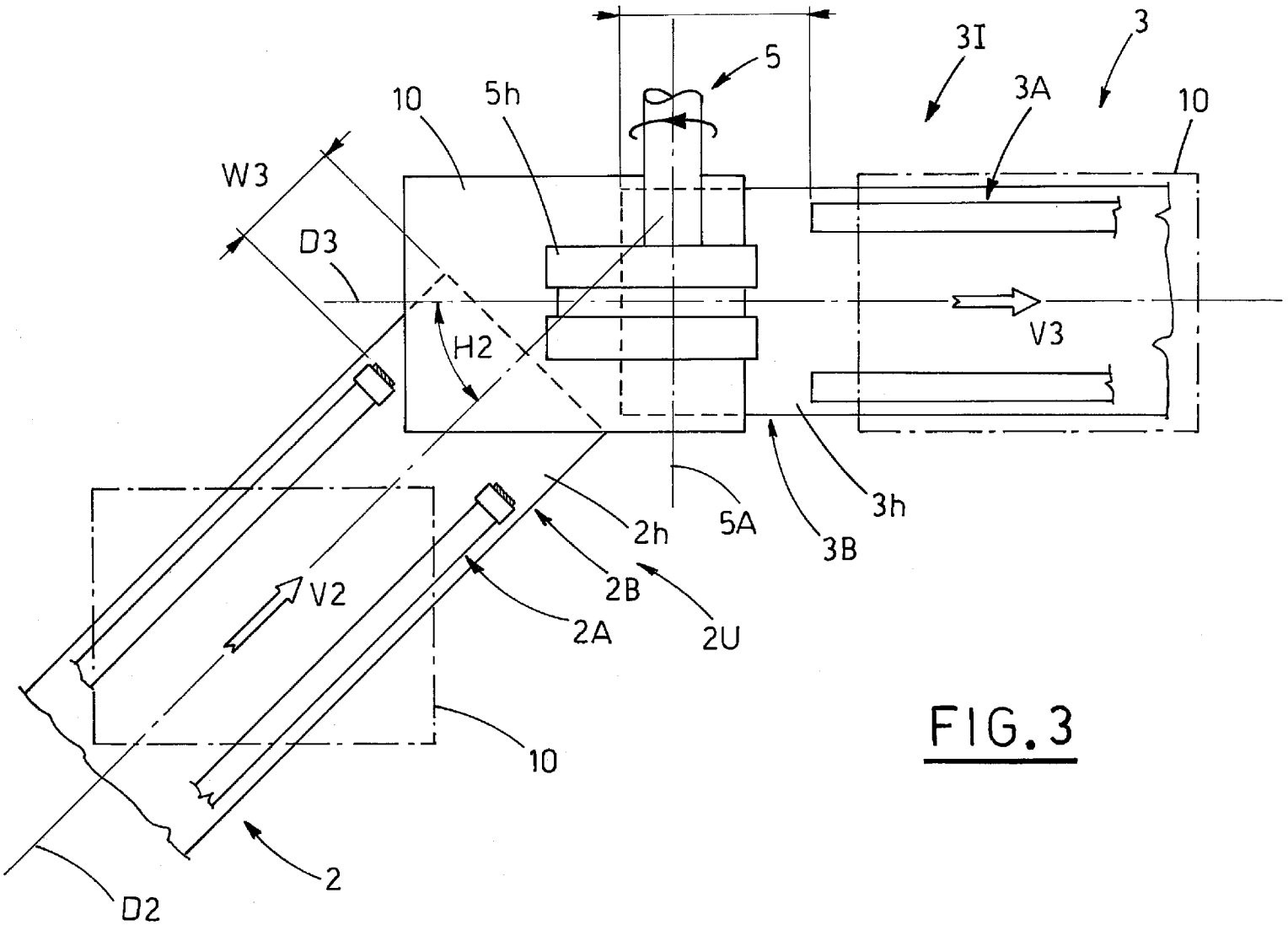
FIG. 3 is an enlarged view of the particular K2 indicated in FIG. 1.

In particular, the lower active run 2*h* extends beyond the upper active run 2*j* by a given quantity W2, W3 at its inlet section 2I as well as at its outlet section 2U (FIG. 3).

The reference numeral 3 indicates a third pair of conveyor belts 3A, 3B (later called third conveyor belt 3A and third lower conveyor belt 3B), functionally disposed in cascade after the second pair of conveyors 2.

The conveyor belts 3A, 3B are arranged with respect to each other in such a way as to define two active runs, a lower run 3*h* and an upper run 3*j*, facing each other along a given section, and operated at the same speed in a third longitudinal direction line D3 and in the forward direction V3.

The two active runs 3*h*, 3*j* are aimed at receiving the sheets 10 at their inlet section 3I and at conveying them, one by one, toward the outlet section.

In particular (see FIG. 3), the lower active run 3*h* extends beyond the upper active run 3*j* by a given quantity W4 at the inlet section 3I.

In the shown example, the second forward direction V2, deviates with respect to the first forward direction V1, e.g. to the right, 45 degrees, and the third forward direction V3 deviates with respect to the first forward direction V1 again to the right. This way, a complete 90 degrees deviation of the conveyors forward direction motion is obtained.

A first rotating diverting member 4 is situated above the lower active run 2*h* of the second lower conveyor belt 2B and particularly near its inlet section 2I, with the related rotation axis 4A perpendicular to the second longitudinal direction line D2.

The first rotating diverting member 4 includes a cam-like element with an active portion 4*h*, made for example of a pliable elastic material (such as rubber or similar material), has a circumference arc profile and is aimed at going in touch with the sheets 10 conveyed to the outlet of the related section 1U of the first conveyor 1.

In a completely analogous way, a second rotating diverting member 5, for example identical to the first member 4, thus likewise including a cam-like element, is situated above the lower active run 3*h* of the third lower conveyor belt 3B and in particular near its inlet section 3I, with its rotation axis 5A perpendicular to the third longitudinal direction line D3.

The second diverting member 5 has an active portion 5*h* of a pliable elastic material (such as rubber or similar material), which has a circumference arc profile and is aimed at going in touch with the sheets 10 conveyed to the outlet of the related section 2U of the second pair of conveyor belts 2.

Relative horizontal supports 6 are interposed between the adjacent conveyors 1, 2, 3, to allow the passage of each sheet article 10 from one pair of conveyor belts to another one.

Figures 4A, 4B:
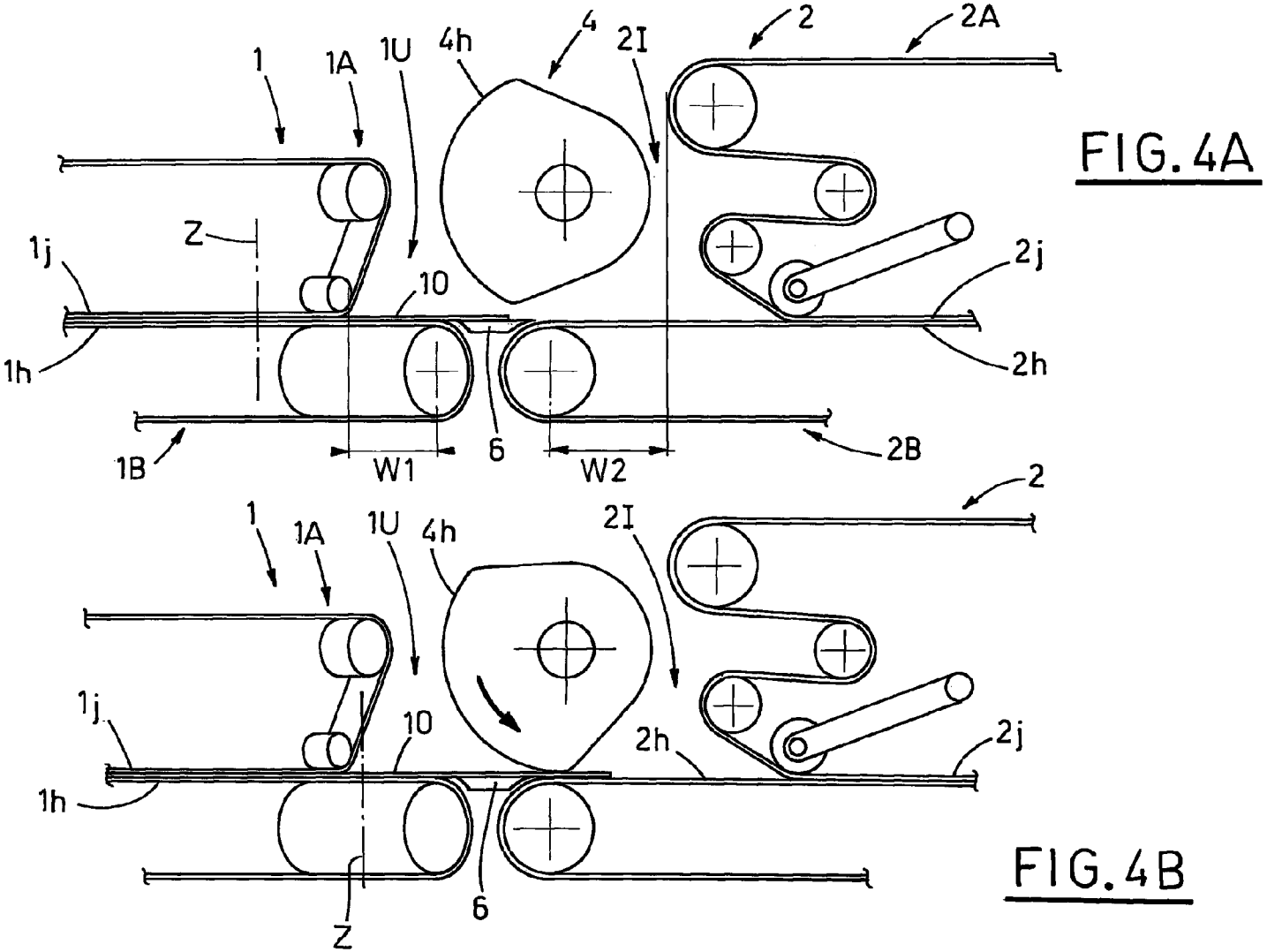
FIG. 4A, 4B are enlarged views according the direction X of FIG. 2, in as many work configurations.

One of the supports 6 is shown schematically only in FIG. 4A, 4B.

The operation of the conveying apparatus for changing the sheets forward motion direction, proposed by the present invention, will be described hereinafter.

The sheets 10 are fed in known and thus not shown way, one after another, to the inlet section of the first conveyor 1 and there they are conveyed along a prefixed longitudinal direction line D1 and in the forward direction V1, toward the related first conveyor outlet section 1U, where they disengage from the upper active run 1*j* of the first upper conveyor belt 1A and gradually go to rest also on the support 6 and then on the lower active run 2*h* of the second lower conveyor belt 2B.

This work step has been schematized in FIG. 2, which shows a sheet article 10 leaving, through the outlet 1U, the first conveyor 1, 1B, disengaging from the upper active run 1*j* of the first upper conveyor belt 1A and contemporarily resting on the support 6 and on the lower active runs 1*h*, 2*h* of the first lower conveyor belt 1B and the second lower conveyor belt 2B.

FIG. 4B shows what has been shown in FIG. 2 according a view in the direction X and is marked by a vertical line Z passing through the right and rearmost corner of the article 10 being concerned, as it is shown in FIG. 2, in order to show its forward motion on the lower active run 1*h* of the first lower conveyor belt 1B.

FIG. 4A is analogous to the FIG. 4B, but it refers to a work configuration related to a previous instant, in which the sheet 10 is still engaged between the lower active run 1*h* and the upper active run 1*j* of the first pair 1 of conveyor belts 1A, 1B (this is confirmed by the rearmost position of the line Z with respect to the first forward direction V1).

The first rotating diverting member 4 is operated in step relation to the motion of the articles 10 through the outlet 1U, leaving the first conveyor 1, and is aimed at touching corresponding portions of the sheet articles 10 just disengaging from the upper active run 1*j* of the first upper conveyor belt 1A and at pushing the sheet articles 10, together with the forward motion of the lower active run 2*h* of the second lower conveyor belt 2B, until they are gripped by the lower active run 2*h* and the upper active run 2*j* of the second conveyor 2.

The active portion 4*h* of the first diverting member 4 (FIG. 4A, 4B) is operated with a tangential speed equal to the operation speed of the lower active run 2*h* of the second lower conveyor belt 2B, so as to avoid any sliding.

The circumference arc shape of the active portion 4*h* allows its rolling on each article 10 leaving the first pair of conveyors 1 through the outlet 1U.

Therefore, the sheet 10 leaving the first pair 1 of conveyor belts 1A, 1B through the outlet 1U (FIG. 2) is pushed by the first rotating diverting member 4, together with the operation of the lower active run 2*h* of the second lower conveyor belt 2B, in the second forward direction V2 and along the second longitudinal direction line D2, without any change of the orientation.

Consequently, the forward motion direction of each sheet 10 changes with a deviation e.g. to the right during the passage from the first conveyor 1 to the second conveyor 2, by a first angle H1, that is by forty-five degrees.

Analogous considerations are valid also for the movement of the sheet articles 10 from the second conveyor 2 including the two conveyor belts 2A, 2B to the third conveyor 3 formed by two conveyor belts 3A, 3B, which causes a further clockwise change in the forward motion direction of the articles by a second angle H2, in the example equal to 45 degrees, which however does not change the articles orientation.

It appears from the above considerations that the conveying apparatus, proposed by the invention, can cause a 90 degrees change of the initial forward motion direction of the sheets 10 conveyed to its inlet, without changing the sheets orientation.

In particular, in the shown example, the forward motion direction of the sheets 10 is changed to the right, being obviously possible to change the direction to the left by providing conveyors so disposed.

A similar apparatus can be perfectly and advantageously integrated with a large quantity of industrial working cycles and FIG. 1 shows its use example, in which a generic sheet article 10 is first cut along its lateral, opposite edges, parallel to the first longitudinal direction line D1, thus its forward motion direction is changed clockwise by 90 degrees and finally it is cut along the median line, parallel to the third longitudinal direction line D3.

Thus, these cutting operations can be carried out at high work speeds and for example, with stationary axis rotating blades, which results in the increase of the production rate and the reduction of the costs and the structural complexity of the plant, to which the conveying apparatus is applied.

Another advantage of the invention lies in the fact that it has defined a conveying apparatus, whose concept is simple, structure essential, and which is efficient, reliable and whose costs are relatively contained with respect to the obtained results.

Therefore, the conveying apparatus proposed by the invention satisfies the objects mentioned in the introductory note, because it can cause, between its inlet section and its outlet section, a ninety degree change of the forward motion direction of the sheet articles fed thereby, maintaining unchanged the articles orientation.

Moreover, the apparatus can work at high work speeds, typically for the applications, in which it is to be integrated.

It is understood that the proposed invention has been described as a mere, not limiting example. Therefore, any practical-use changes or variants applied thereto remain within the protective scope of the invention as described above and claimed below.

The invention claimed is:

1. A conveying apparatus for changing a forward motion direction of sheet articles comprising:

at least a first conveyor (1) with at least a first conveyor lower active run (1*h*) extending between a first conveyor inlet section and a first conveyor outlet section (1U), the first conveyor being operated along a first longitudinal direction line (D1) and in a first forward direction (V1) for moving forward said sheet articles (10);

at least a second conveyor (2) disposed functionally in cascade after the first conveyor (1), and having at least a second conveyor lower active run (2*h*) extending between a second conveyor inlet section and a second conveyor outlet section, the second conveyor being operated at a speed in a second forward direction (V2), substantially concordant with the speed in the first forward direction (V1) and along a second longitudinal direction line (D2) inclined by a first angle (H1) with respect to said first longitudinal direction line (D1);

a first rotating diverting member (4), situated above said second conveyor lower active run (2*h*) of said second conveyor (2) and near said second conveyor inlet section (2I), the first diverting member having a rotation axis (4A) substantially perpendicular to said second longitudinal direction line (D2), and operated in time relation with a passage of a sheet article (10) on said first conveyor (1), said first rotating diverting member (4) having an active portion (4*h*) designed to contact corresponding portions of each sheet article (10) arriving at said first conveyor 30 outlet section (1U) and to push the sheet article onto said second conveyor (2), without changing orientation of said sheet article;

at least a third conveyor (3), situated functionally in cascade after said second conveyor (2), and having at least a third conveyor lower active run (3*h*) extending between a third conveyor inlet section (3I) and a third conveyor outlet section, the third conveyor being operated at a speed in a third forward direction (V3), substantially concordant with a speed in said second forward direction (V2), and along a third longitudinal direction line (D3) inclined by a second angle (H2) with respect to said second longitudinal direction line (D2);

a second rotating diverting member (5), situated above the third conveyor lower active run (3*h*) and near said third conveyor inlet section (3I) with a rotational axis (5A) substantially perpendicular to said third longitudinal direction line (D3), the second rotating diverting member being operated in time relation with passage of a sheet article (10) on said second conveyor (2), and said second rotating diverting member (5) having an active portion (5*h*) for contacting corresponding portions of each sheet article (10) arriving at said second conveyor outlet section (2U) and for pushing the sheet article onto said third conveyor (3), without changing orientation of the sheet article;

said second conveyor (2) further including a second pair of conveyor belts (2A, 2B), arranged with respect to each other in such a way as to define a second conveyor lower run (2*h*) and a second conveyor upper run (2*j*), facing each other along a prefixed portion, and operated at the same speed along said second longitudinal direction line (D2) and in the second forward direction (V2), said second conveyor lower and upper active runs (2*h*, 2*j*) receiving said sheet articles (10), pushed by a first rotating diverting member (4) and conveying the sheet articles, one by one, toward the second conveyor outlet section (2U), said second conveyor lower active run (2*h*) extending beyond said upper second conveyor active run (2*j*), at said second conveyor outlet section (2U), by a first given quantity (W3);

said third conveyor (3) including a third pair of conveyor belts (3A, 3B), arranged with respect to each other to define the third conveyor lower active run (3*h*) and a third conveyor upper active run (3*j*) facing each other along a given section, and operated at a same speed along said third longitudinal direction line (D3) and in the third forward direction (V3), said two third conveyor lower and upper active runs (3*h*, 3*j*) receiving the sheet articles (10), pushed by said second rotating diverting member (5) at the third conveyor inlet section (3I) of the third pair of conveyor belts (3A, 3B), and conveying the sheet articles, one by one, toward the third conveyor outlet section, the third conveyor lower active run (3*h*) extending beyond the third conveyor upper active run by a second given quantity (W4) at the third conveyor inlet section (3I);

said second rotating diverting member (5) being situated above said third conveyor lower active run (3*h*) of said third conveyor (3) pair of conveyor belts (3A, 3B) and near said third conveyor inlet second (3I), having a rotational axis (5A) substantially perpendicular to said third longitudinal direction line (D3), being operated in time relation with a passage of said sheet articles (10) at the second conveyor outlet (2U) of said second conveyor (2) pair of conveyor belts (2A, 2B) and having an active portion (5*h*) for contacting corresponding portions of each sheet article (10) arriving at said second conveyor outlet section (2U) and for pushing the sheet article in combination with the forward motion of the third conveyor lower active run (3*h*) of said third conveyor (3) pair of conveyor belts (3A, 3B) and without changing orientation of the sheet article, at least until the sheet article is gripped by said third conveyor lower run (3*h*) and said third conveyor upper run of said third conveyor (3) pair of conveyor belts (3A, 3B).

2. An apparatus, according to claim 1, wherein said first angle (H1) and said second angle (H2) are of forty five degrees, to define a total change of the forward motion direction of each of said sheet articles (10), between said first conveyor inlet section and said third conveyor outlet section, by ninety degrees and without changing the orientation of the sheet articles.

3. An apparatus, according to claim 1, wherein:

said first conveyor (1) includes a first pair of conveyor belts (1A, 1B), arranged with respect to each other in such a way as to define, beside said first conveyor lower active run (1*h*), also a first conveyor upper active run (1*j*), said first conveyor lower active run (1*h*) and first conveyor upper active run (1*j*) facing each other along a prefixed portion and operated at the same speed along said first longitudinal direction line (D1) and in the first forward 10 direction (V1), said first conveyor lower active run (1*h*) and first conveyor upper active run (1*j*) receiving said sheet articles (10) at said first conveyor inlet section and conveying the sheet articles, one by one, toward the first conveyor outlet section (1U), with said first conveyor lower active run (1*h*) extending beyond said first conveyor upper active run (1*j*), at said first conveyor outlet section (1U), by a given quantity (W1);

said second conveyor (2) includes a second pair of conveyor belts (2A, 2B), arranged with respect to each other in such a way as to define, beside said second conveyor lower active run (2*h*), also a second conveyor upper active run (2*j*) facing said second conveyor lower active run (2*h*) along a given section and operated at the same speed along said second longitudinal direction line (D2) and in the second forward direction (V2), said second conveyor lower and upper active runs (2*h*, 2*j*) receiving the sheet articles (10), pushed by said first rotating diverting member (4) at the second conveyor inlet section (21) of the second pair of conveyor belts (2A, 2B), and conveying the sheet articles, one by one, toward the second conveyor outlet section (2U), the second conveyor lower active run (2*h*) extending beyond the second conveyor upper active run (2*j*) by a given quantity (W2) at the second conveyor inlet section (2I);

said first rotating diverting member (4) is situated above said second conveyor lower active run (2*h*) of said second conveyor (2) and near said second conveyor inlet section (2I), has a rotational axis (4A) substantially perpendicular to said second longitudinal direction line (D2), is operated in time relation with the passage of said sheet articles (10) at the first conveyor outlet (1U) of said first conveyor (1) pairs of conveyor belts (1A, 1B), and has an active portion (4*h*) for contacting corresponding portions of each sheet article (10) arriving at said first conveyor outlet section (1U) of said first conveyor (1) pair of conveyor belts (1A, 1B) and for pushing the sheet article, in combination with the forward motion of the second conveyor lower active run (2*h*) of said second conveyor (2) pair of conveyor belts (2A, 2B) and without changing orientation of the sheet article, at least until the sheet article is gripped by said second conveyor lower run (2*h*) and said second conveyor upper run (2*j*) of said second conveyor (2) pair of conveyor belts (2A, 2B).

4. An apparatus, according to claim 1, wherein said active portion (4*h*) of said first rotating diverting member (4) forms a circumference arc.

5. An apparatus, according to claim 1, wherein said active portion (5*h*) of said second rotating diverting member (5) forms a circumference arc.

6. An apparatus, according to claim 1, wherein said first rotating diverting member (4) is a cam-like element.

7. An apparatus, according to claim 1, wherein said second rotating diverting member (5) is a cam-like element.

8. An apparatus, according to claim 4, wherein said first rotating diverting member (4) is a cam-like element.

9. An apparatus, according to claim 5, wherein said second rotating diverting member (5) is a cam-like element.

10. A conveying apparatus for changing a forward motion direction of sheet articles comprising:

at least a first conveyor (1) with at least a first conveyor lower active run (1*h*) extending between a first conveyor inlet section and a first conveyor outlet section (1U), the first conveyor being operated along a first longitudinal direction line (D1) and in a first forward direction (V1) for moving forward said sheet articles (10);

at least a second conveyor (2) disposed functionally in cascade after the first conveyor (1), and having at least a second conveyor lower active run (2*h*) extending between a second conveyor inlet section and a second conveyor outlet section, the second conveyor being operated at a speed in a second forward direction (V2), substantially concordant with the speed in the first forward direction (V1) and along a second longitudinal direction line (D2) inclined by a first angle (H1) with respect to said first longitudinal direction line (D1);

a first rotating diverting member (4), situated above said second conveyor lower active run (2*h*) of said second conveyor (2) and near said second conveyor inlet section (2I), the first diverting member having a rotation axis (4A) substantially perpendicular to said second longitudinal direction line (D2), and operated in time relation with a passage of a sheet article (10) on said first conveyor (1), said first rotating diverting member (4) having an active portion (4*h*) designed to contact corresponding portions of each sheet article (10) arriving at said first conveyor outlet section (1U) and to push the sheet article onto said second conveyor (2), without changing orientation of said sheet article;

said first conveyor (1) including a first pair of conveyor belts (1A, 1B), arranged with respect to each other in such a way as to define, beside said first conveyor lower active run (1*h*), a first conveyor upper active run (1*j*), said first conveyor lower active run (1*h*) and first conveyor upper active run (1*j*) facing each other along a prefixed portion and operated at the same speed along said first longitudinal direction line (D1) and in the first forward 10 direction (V1), said first conveyor lower active run (1*h*) and first conveyor upper active run (1*j*) receiving said sheet articles (10) at said first conveyor inlet section and conveying the sheet articles, one by one, toward the first conveyor outlet section (1U), with said first conveyor lower active run (1*h*) extending beyond said first conveyor upper active run (1*j*), at said first conveyor outlet section (1U), by a first given quantity (W1);

said second conveyor (2) including a second pair of conveyor belts (2A, 2B), arranged with respect to each other in such a way as to define, beside said second conveyor lower active run (2*h*), a second conveyor upper active run (2*j*) facing said second conveyor lower active run (2*h*) along a given section and operated at the same speed along said second longitudinal direction line (D2) and in the second forward direction (V2), said second conveyor lower and upper active runs (2*h*, 2*j*) receiving the sheet articles (10), pushed by said first rotating diverting member (4) at the second conveyor inlet section (2I) of the second pair of conveyor belts (2A, 2B), and conveying the sheet articles, one by one, toward the second conveyor outlet section (2U), the second conveyor lower active run (2*h*) extending beyond the second conveyor upper active run (2*j*) by a second given quantity (W2) at the second conveyor inlet section (2I);

said first rotating diverting member (4) being situated above said second conveyor lower active run (2*h*) of said second conveyor (2) and near said second conveyor inlet section (2I), and having a rotational axis (4A) substantially perpendicular to said second longitudinal direction line (D2), and being operated in time relation with the passage of said sheet articles (10) at the first conveyor outlet (1U) of said first conveyor (1) pairs of conveyor belts (1A, 1B), and having an active portion (4*h*) for contacting corresponding portions of each sheet article (10) arriving at said first conveyor outlet section (1U) of said first conveyor (1) pair of conveyor belts (1A, 1B) wherein said active portion (4*h*) of said first rotating diverting member (4) forms a circumference arc, the active portion being operated with a tangential speed equal to an operating speed of the lower active run (2*h*) of the second lower conveyor belt (2B) so as to be able to push the sheet article, just disengaging from the upper active run (1*j*) of the first conveyor belt (1A), avoiding any sliding, in combination with the forward motion of the second conveyor lower active run (2*h*) of said second conveyor (2) pair of conveyor belts (2A, 2B) and without changing orientation of the sheet article, at least until the sheet article is gripped by said second conveyor lower run (2*h*) and said second conveyor upper run (2*j*) of said second conveyor (2) pair of conveyor belts (2A, 2B).

11. An apparatus, according to claim 10, further including:

at least a third conveyor (3), situated functionally in cascade after said second conveyor (2), and having at least a third conveyor lower active run (3*h*) extending between a third conveyor inlet section (3I) and a third conveyor outlet section, the third conveyor being operated in a third forward direction (V3), substantially concordant with said second forward direction (V2), and along a third longitudinal direction line (D3) inclined by a second angle (H2) with respect to said second longitudinal direction line (D2);

a second rotating diverting member (5), situated above the third conveyor lower active run (3*h*) and near said third conveyor inlet section (3I) with a rotational axis (5A) substantially perpendicular to said third longitudinal direction line (D3), the second rotating diverting member being operated in time relation with passage of a sheet article (10) on said second conveyor (2), and said second rotating diverting member (5) having an active portion (5*h*) for contacting corresponding portions of each sheet article (10) arriving at said second conveyor outlet section (2U) and for pushing the sheet article onto said third conveyor (3), without changing orientation of the sheet article.

12. An apparatus, according to claim 11, wherein said first angle (H1) and said second angle (H2) are of forty five degrees, to define a total change of the forward motion direction of each of said sheet articles (10), between said first conveyor inlet section and said third conveyor outlet section, by ninety degrees and without changing the orientation of the sheet articles.

13. An apparatus, according to claim 10, wherein said active portion (5*h*) of said second rotating diverting member (5) forms a circumference arc.

14. An apparatus, according to claim 10, wherein said first rotating diverting member (4) is a cam-like element.

15. An apparatus, according to claim 10, wherein said second rotating diverting member (5) is a cam-like element.

* * * * *